United States Patent [19]

Davison et al.

[11] Patent Number: 4,608,099

[45] Date of Patent: Aug. 26, 1986

[54] GENERAL PURPOSE MAINTENANCE-FREE CONSTRUCTIONAL STEEL OF SUPERIOR PROCESSABILITY

[75] Inventors: Ralph M. Davison, Arvada, Colo.; Paul J. Grobner, Ann Arbor, Mich.

[73] Assignee: Amax Inc., Greenwich, Conn.

[21] Appl. No.: 659,463

[22] Filed: Oct. 10, 1984

[51] Int. Cl.[4] ..... C22C 38/22; C22C 38/44

[52] U.S. Cl. ..... 148/37; 75/126 C; 75/128 W; 75/124; 75/126 D; 75/128 T

[58] Field of Search ..... 75/124 C, 126 C, 128 W, 75/126 D, 128 T; 148/37, 12 E, 12.1

[56] References Cited

U.S. PATENT DOCUMENTS 2,306,421 12/1942 Arness ..... 75/126 C
3,832,244 8/1974 Pinnow et al. ..... 148/37
4,326,885 4/1982 Larson et al. ..... 75/126 C

FOREIGN PATENT DOCUMENTS 53-58423 5/1978 Japan ..... 75/124 B
56-62947 5/1981 Japan ..... 75/128 W

*Primary Examiner*—L. Dewayne Rutledge
*Assistant Examiner*—Deborah Yee
*Attorney, Agent, or Firm*—Michael A. Ciomek; Michael J. Weins

[57] ABSTRACT

This invention relates to an improved corrosion resistant steel which nominally contains: 0.015–0.031% C, 11–12% Cr, 0.2–0.5% Mo, 1.5% max Ni, 1.5% max Mn, 0.8% max Si, 0.05% max Ti, 0.03% max N, 0.03% max P, 0.03% max S with the balance Fe. The steel of the present invention has good toughness with a relatively low ductile to brittle transition temperature. In the rolled and tempered condition the steel has a mixed microstructure consisting of tempered martensite and ferrite.

6 Claims, 2 Drawing Figures

GENERAL PURPOSE MAINTENANCE-FREE CONSTRUCTIONAL STEEL OF SUPERIOR PROCESSABILITY

FIELD OF INVENTION

This invention relates to an improved corrosion resistant steel which contains 0.015–0.031% C, 11–12% Cr, 0.2–0.5% Mo, 1.5%max Ni, 1.5% Mn max, 0.8% Si max, 0.05%max Ti, 0.03%max N, 0.03%max P, 0.03%max S with the balance Fe.

BACKGROUND

Ferritic steels with improved corrosion resistance, such as AISI 409 which contains 0.03%C max, 10.5–11.7%Cr and titanium as a stabilizer, although frequently used for structural applications, have a number of disadvantages including their relatively low toughness and yield strength. In addition they may not be suitable for certain structural applications in which welding is required.

To overcome some of the limitations of ferritic steels such as AISI 409, steels with a ferritic-martensitic microstructure and improved strength and weldability have been developed. Typical of these steels is 3CR12 which nominally contains 0.025% C, 11.45% Cr, 0.4% Ni, 0.8%max Mn, 0.45%max Si, 0.21% Ti, 0.014% S, 0.020% P and 0.013% N and is further described in South African Pat. No. 78/4764. The titanium addition is for the purpose of modifying the response of the steel to heat treatment. The residual molybdenum content in these steels is about 0.04%.

Steels such as 3CR12 may not have sufficient impact strength for certain applications. In addition the titanium may contribute to the formation of a coarse grained ferritic structure in the heat affected zone upon welding. A coarse grained ferritic weld zone will have reduced toughness. Thus the need exists for a steel which can be welded while maintaining strength and toughness.

SUMMARY OF INVENTION

The steel of the present invention is an improved corrosion resistant steel which contains 0.015–0.031% C, 11–12% Cr, 0.2–0.5% Mo, 1.5%max Ni, 1.5% Mn max, 0.8% Si max, 0.05%max Ti, 0.03%max N, 0.03%max P, 0.03%max S with the balance Fe.

The steel of the present invention has a composition similar to that of 3CR12 steel with the exception that the titanium has been replaced with about 0.25% Mo. Molybdenum in the steel of the present invention provides a function similar to that provided by titanium in the 3CR12 steel, however the molybdenum containing steel of the present invention has superior impact properties and the molybdenum is more easily controlled.

The steel of the present invention does not need to be normalized. Preferably the steel of the present invention is introduced into service after it has been hot rolled between about 750° C.–800° C. (1380° F.–1470° F.) and tempered at 670° C.–730° C. (1240° F.–1345° F.) for 1 hour.

BEST MODE OF CARRYING THE INVENTION INTO PRACTICE

The present invention is directed to an improved corrosion resistant steel which contains: 0.015–0.031% C, 11–12% Cr, 0.2–0.5% Mo, 1.5%max Ni, 1.5% Mn max, 0.8% Si max, 0.05%max Ti, 0.03%max N, 0.03%max P, 0.03%max S with the balance Fe.

In a preferred embodiment of the present invention the molybdenum is further restricted to a maximum of 0.3% and the aluminum is further restricted to a maximum of 0.05%.

The steel of the present invention has a composition similar to that of 3CR12 steel with the exception that the titanium has been replaced with about 0.25% Mo. Molybdenum in the steel of the present invention provides a function similar to that provided by titanium in the 3CR12 steel. However the molybdenum containing steel of the present invention has superior impact properties and, in addition, the molybdenum is more easily controlled.

The composition of the steel of the present invention is such as to assure that the steel maintains strength, weldability and impact toughness. The carbon content is sufficient to maintain the strength without impairing weldability and impact toughness. The manganese is limited since excess manganese can reduce impact toughness. The silicon is limited to prevent formation of an excess of delta ferrite, delta ferrite can reduce the strength. The chromium content is maintained within limits to assure sufficient corrosion resistance while maintaining weldability. The limits on the molybdenum content assure effective strengthening and corrosion resistance. The nickel is limited to prevent formation of retained austenite since retained austenite would reduce the yield strength. The titanium is limited because titanium can reduce hardenability. The nitrogen content is restricted to avoid formation of chromium nitrides which would reduce the toughness, as well as the corrosion resistance of the steel. The sulphur and phosphorus contents are kept to within the usual limits for structural steels.

It has been found that the use of molybdenum and the elimination of titanium has a number of advantages. Molybdenum improves the strength and impact properties, and the molybdenum content can be more easily controlled than can the titanium content. Experience with the alloy of the present invention shows a molybdenum recovery of 98% to 100%. The advantages of alloying with molybdenum are further discussed by J. L. Gregg in "The Alloys of Iron and Molybdenum".

Figure 1:
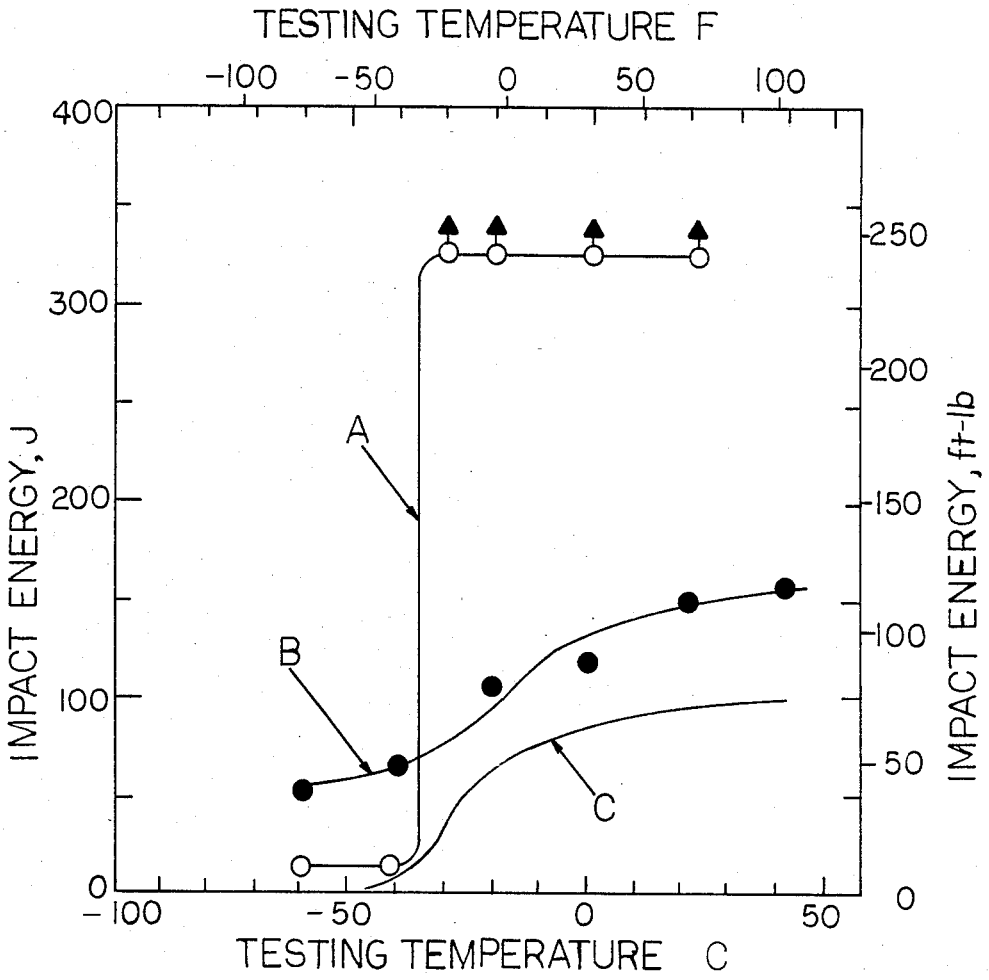
FIG. 1 is a graph plotting impact energy versus temperature for a steel of the present invention and a 3CR12 prior art steel.
Figure 2:
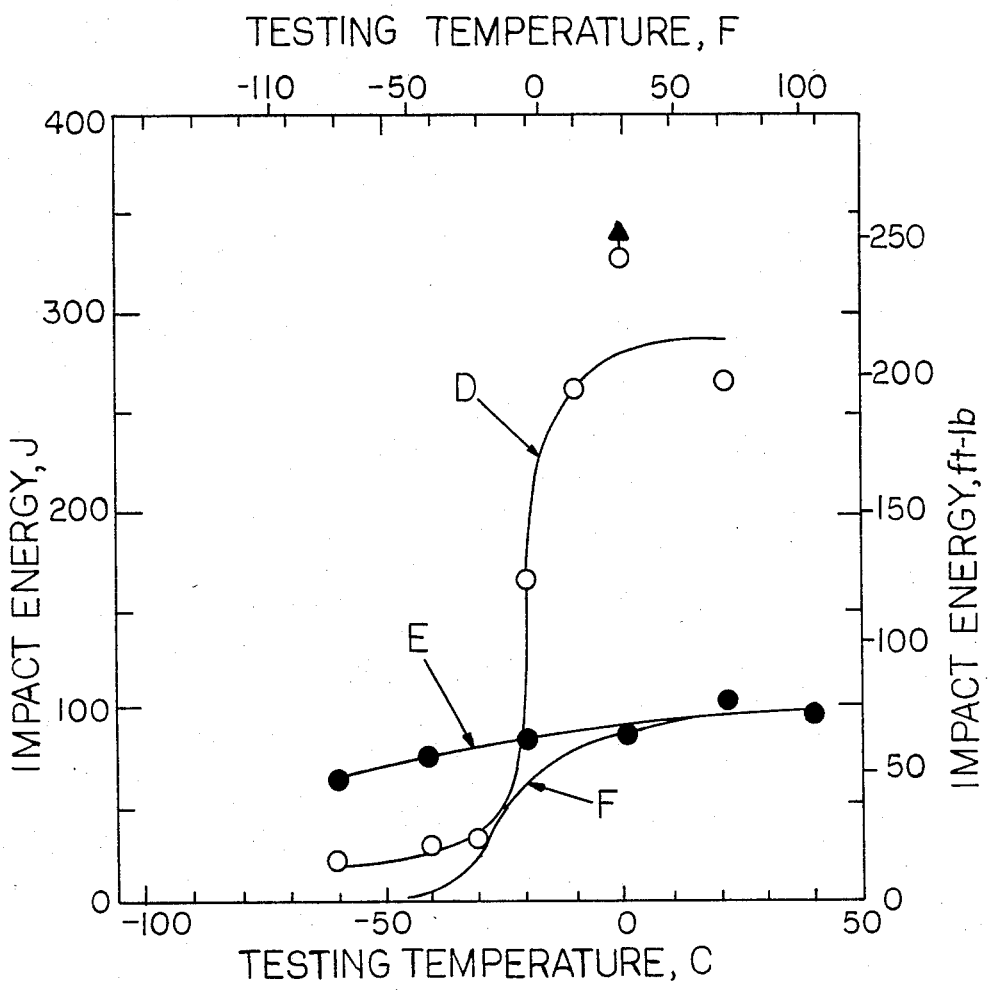
FIG. 2 is a graph plotting impact energy versus temperature for another steel of the present invention and a 3CR12 prior art steel.

FIGS. 1 and 2 illustrate the improvement in the impact strength of the steel of the present invention relative to the prior art 3CR12 steel. The compositions of the steels which were impact tested are shown in Table I.

TABLE I

| | COMPOSITION OF STEELS TESTED | | | | | | | | | |
|---|---|---|---|---|---|---|---|---|---|---|
| HEAT | C | Mn | Ti | Si | Cr | Mo | N | P | S | N |
| A&B | 0.019 | 1.00 | <0.01 | 0.44 | 11.11 | 0.26 | 0.62 | 0.011 | 0.012 | 0.0136 |
| D&E | 0.019 | 1.20 | <0.01 | 0.46 | 11.10 | 0.26 | 0.61 | 0.018 | 0.020 | 0.0134 |
| C&F | 0.025 | 0.80 | 0.2 | 0.51 | 11.5 | — | 0.4 | 0.02 | 0.014 | 0.013 |

FIG. 1 shows the impact properties of a steel of the present invention, curves A and B and of the prior art 3CR12 steel, curve C. FIG. 2 shows the impact properties of another steel of the present invention, curves D and E as compared to the prior art 3CR12 steel, curve F. All steels were hot rolled at 800° C. and then tempered. The steels of the present invention were impact tested after two different tempering treatments. For FIG. 1 the steel represented by Curve A was tempered at 730° C. (1345° F.) for 1 hour, the steel represented by curve B was tempered 660° C. (1220° F.) for 1 hour. For FIG. 2 the steel represented by curve D was tempered at 740° C. (1365° F.) for 1 hour, while steel represented by curve E was tempered 670° C. (1240° F.) for 1 hour. In both FIGS. 1 and 2 the prior art 3CR12 steel as depicted in curves C and F was tempered at between 700° C. and 750° C. (1290° F. and 1380° F.). As can been seen from an examination of FIGS. 1 and 2 the steel of the present invention has superior impact properties when compared to the prior art 3CR12 steel.

Preferably the chemistry of the steel of the present invention should be controlled so that the ferrite factor (FF) is maintained within the range of 8 to 13 with the preferred range being between 8 and 11. The ferrite factor, FF is defined by the formula:

$$FF = \%Cr + 6x\%Si + 8x\%Ti + 4x\%Mo + 2x\%Al - 2x\%Mn - 4x\%Ni - 40x(\%C + \%N).$$

The lower limit of FF represents a composition with a small amount of ferrite in the as-cast condition. Some ferrite in the as-cast condition is beneficial for easy weldability. The upper limit on the ferrite factor of 13 corresponds to a composition with more than 50% ferrite in the as-cast condition, a ferrite content higher than about 50% could be detrimental to the strength.

Preferably the improved steel of the present invention is hot rolled at between about 750° C. and 800° C. (1380° F. and 1470° F.) and then tempered at between 670° C. and 730° C. (1240° F. and 1345° F.) for 1 hour. In the rolled and tempered condition the steel of the present invention has a mixed microstructure of tempered martensite and ferrite. After the recommended treatment the steel has a yield strength of 303 MPa to 450 MPa (44 ksi to 65 ksi), a tensile strength of 455 MPa to 600 MPa (66 ksi to 87 ksi) with an elongation of 23% to 32% and a reduction of area of 70% to 76%. In the tempered condition the steel exhibits good impact toughness with a ductile-to-brittle transition temperature of −30° C. to −10° C. (−20° F. to 15° F.) and with room temperature impact energies of over 100 J (74 ft-lb). The spread with respect to the mechanical properties results from the variation of the composition as well as from variation in heat treatment. Narrow ranges of mechanical properties can be achieved by selecting the appropriate tempering temperature. Tempering in the range of about 660° C.–670° C. (1220° F.–1240° F.) is recommended to reach a yield strength of 480MPa–510MPa (70ksi–74ksi) and tempering in the range of about 700° C.–720° C. (1290° F.–1330° F.) is recommended to reach a yield strength of 290MPa–320-MPa (42ksi–46ksi).

TABLE II

PROPERTIES OF ALLOYS TESTED STRENGTH

| HEAT | TEMPER C. | TEMPER F. | YIELD STRENGTH MPa | YIELD STRENGTH (ksi) | TENSILE STRENGTH MPa | TENSILE STRENGTH (ksi) |
|---|---|---|---|---|---|---|
| A | 660 | (1220) | 489 | (71) | 572 | (83) |
| A | 700 | (1290) | 296 | (43) | 455 | (66) |
| A | 730 | (1345) | 255 | (37) | 427 | (62) |
| B | 670 | (1240) | 510 | (74) | 600 | (87) |
| B | 720 | (1330) | 303 | (44) | 462 | (67) |
| B | 740 | (1365) | 269 | (39) | 462 | (67) |

TABLE III

PROPERTIES OF ALLOYS TESTED ELONGATION, REDUCTION IN AREA AND HARDNESS

| HEAT | TEMPER C. | TEMPER F. | ELONGATION % | REDUCTION IN AREA % | HARDNESS HB |
|---|---|---|---|---|---|
| A | 660 | (1220) | 23 | 70 | 183 |
| A | 700 | (1290) | 33 | 78 | 138 |
| A | 730 | (1345) | 38 | 81 | 129 |
| B | 670 | (1240) | 21 | 69 | 195 |
| B | 720 | (1330) | 32 | 76 | 143 |
| B | 740 | (1365) | 35 | 76 | 131 |

What we claim is:

1. A dual phase steel of ferrite and martensite of 0.015–0.031% C, 11–12% Cr, 0.2–0.5% Mo, 1.5%max Ni, 1.5%max Mn, 0.8%max Si, 0.05%max Ti, 0.03%max N, 0.03%max P, 0.03%max S, with the balance Fe; wherein the composition is further limited such that the ferrite factor is maintained between about 8 and 13, the ferrite factor, FF, is defined by the formula:

$$FF = \%Cr + 6x\%Si + 8x\%Ti + 4x\%Mo + 2x\%Al - 2x\%Mn - 4x\%Ni - 40x(\%C + \%N).$$

2. The steel of claim 1 wherein the composition is further limited such that the ferrite factor is maintained between about 8 and 11.

3. The steel of claim 1 wherein Mo, Ti and Al are limited to: 0.3% max Mo, 0.03% max Ti and 0.05% max Al.

4. The steel of claim 3 wherein the composition is further limited such that the ferrite factor is maintained between about 8 and 11.

5. A dual phase steel of ferrite and martensite consisting essentially of: 0.015–0.031% C, 11–12% Cr, 0.8–0.5% Mo, 1.5%max Ni, 1.5%max Mn, 0.8%max Si, 0.05%max Ti, 0.03%max N, 0.03%max P, 0.03%max S, with the balance Fe; wherein said steel is hot rolled at between about 750° C. and 800° C. and tempered for 1 hour at a temperature between 670° C. and 730° C.

6. The steel of claim 5 wherein Mo, Ti and Al are limited to: 0.3%max Mo, 0.03%max Ti, and 0.05max Al.

* * * * *